United States Patent [19]

Green

[11] 3,942,396

[45] Mar. 9, 1976

[54] CARTRIDGE CASE EXTRACTING TOOL

[75] Inventor: Robert S. Green, Fredericksburg, Va.

[73] Assignee: The United States of America as represented by the Secretary of the Navy, Washington, D.C.

[22] Filed: Nov. 12, 1974

[21] Appl. No.: 523,097

[52] U.S. Cl. ..... 81/3.05

[51] Int. Cl.[2] ..... B25B 27/00

[58] Field of Search ..... 81/3.05, 72; 29/259, 263, 29/265, 282, 255

[56] References Cited

UNITED STATES PATENTS

| | | | |
|---|---|---|---|
| 2,031,998 | 2/1936 | Bliss | 29/265 |
| 2,341,677 | 2/1944 | Wass | 29/265 |
| 2,991,674 | 7/1961 | Uhl | 81/72 |

FOREIGN PATENTS OR APPLICATIONS

| | | | |
|---|---|---|---|
| 663,249 | 4/1929 | France | 29/265 |

*Primary Examiner*—Al Lawrence Smith
*Assistant Examiner*—Roscoe V. Parker

[57] ABSTRACT

A tool designed to fit into the breech end of an artillery piece to engage the rim of a ruptured cartridge case and to cause extraction of the cartridge case, comprising, a tubular housing having mounted on one end expandable jaws which act as a clutch head, a rod coaxially disposed within the tubular housing and having a cone on one end for camming said jaws outwardly to engage the cartridge rim and a strong back coupled to the tubular housing and through which the extraction force is applied.

7 Claims, 3 Drawing Figures

CARTRIDGE CASE EXTRACTING TOOL

BACKGROUND OF THE INVENTION

1. Field of the Invention

The extraction of a cartridge will occasionally leave the forward end of the case lodged in the chamber while the flanged portion is removed. The present invention relates to the field of art dealing with those tools especially constructed for the extraction of such ruptured cartridge cases.

2. Description of the Prior Art

In the past, one tool for extracting a broken cartridge case was comprised of two half moon plates with two compression springs inserted between them. The springs could be compressed to allow the tool to slip through the cartridge case where the springs would spread the plates into point contact with the inside of the barrel. A problem with this tool was that the half moon plates had a shorter radius of curvature than that of the barrel due to the fact that they had to pass through the cartridge case. Since there was only a small area of contact between the plates and the inner rim of the cartridge case, the case would sometimes bend, or its edges break off, or the tool would slip off upon extraction leaving the cartridge still stuck in the barrel.

SUMMARY OF THE INVENTION

The present invention provides a simple and effective device whereby ruptured cartridge cases may be quickly and safely extracted from the gun barrel without damage to the barrel. It also provides for segmented extraction jaws with their radius of curvature equal to that of the barrel so that the surface contact area between the inner rim of the cartridge case and the jaws is substantially increased, thereby causing extraction of the entire cartridge upon removal of the tool.

BRIEF DESCRIPTION OF THE DRAWING(S)

DESCRIPTION OF THE PREFERRED EMBODIMENT

Figure 1:
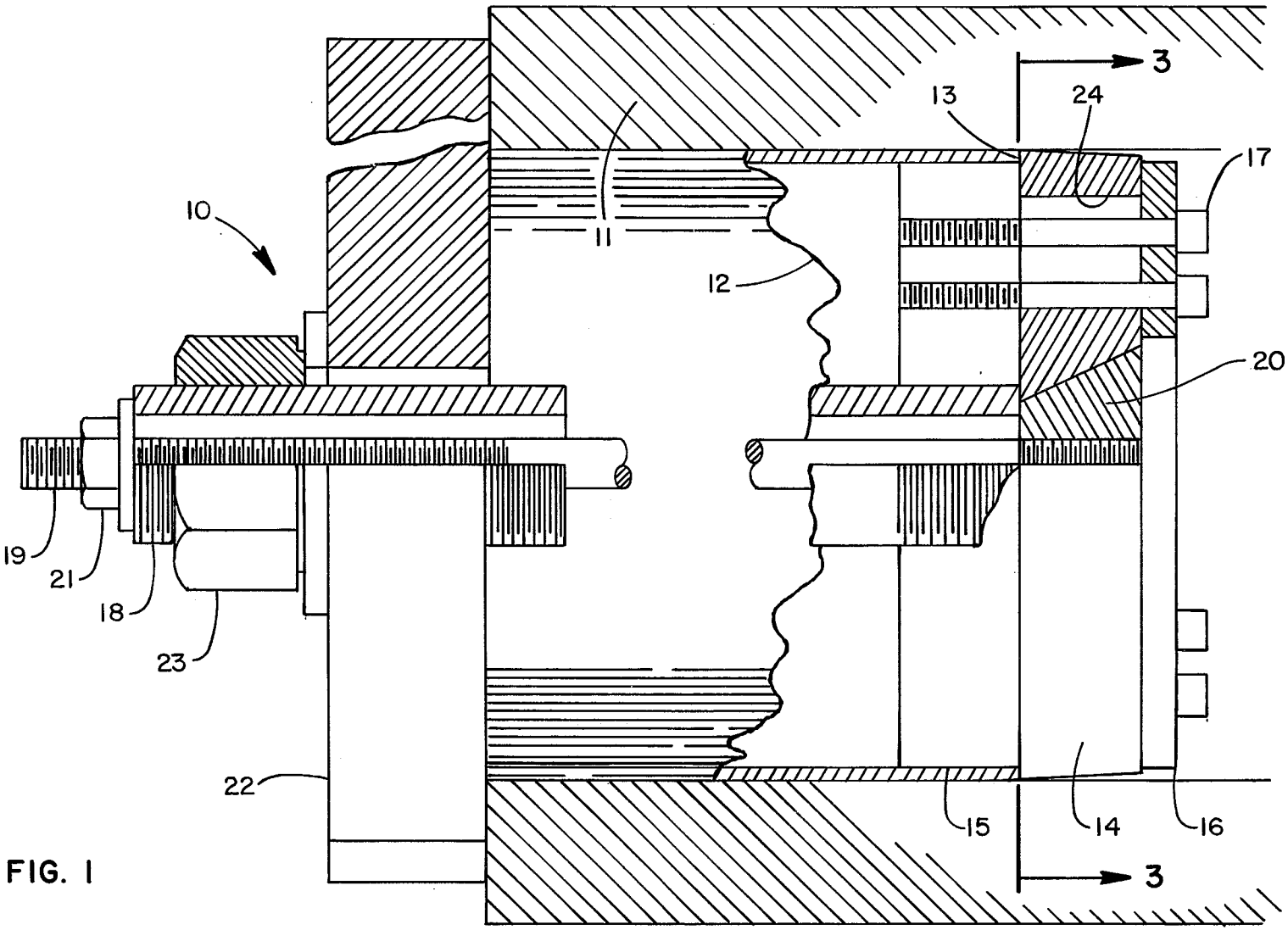
FIG. 1 is a view partially in cross-section of the extraction device with the extracting jaws expanded and in position in the gun barrel.
Figure 3:
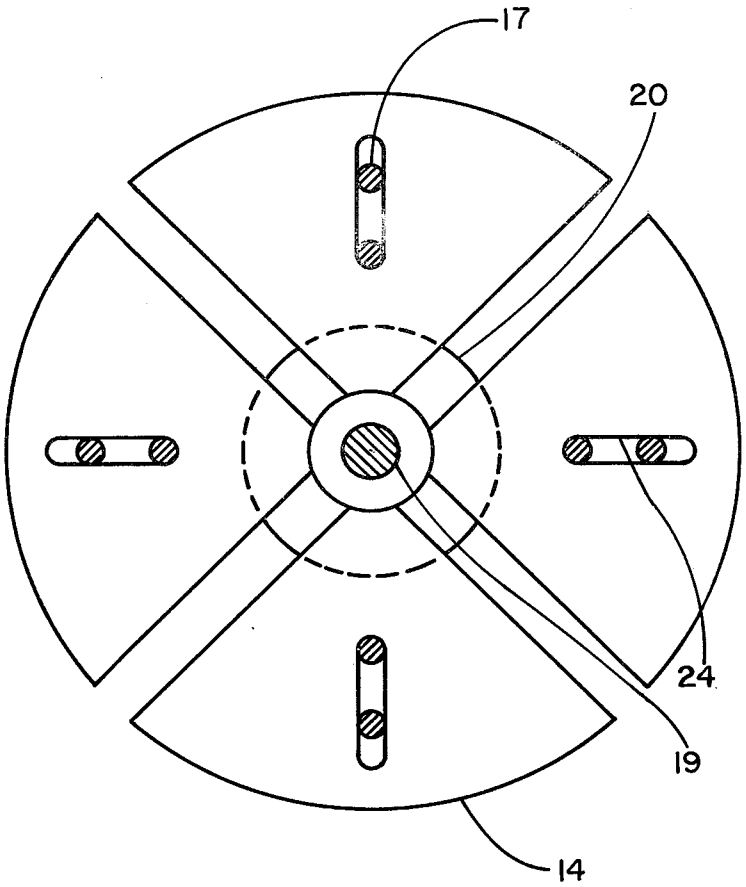
FIG. 3 is a cross-sectional view taken along the 3-3 line of FIG. 1 and illustrating better the configuration of the extraction jaws.

Attention is now directed to the drawings, and more particularly to FIG. 1 wherein is disclosed a case extracting tool generally designated by the reference numeral 10 in position in a gun barrel 11 beyond a sheared cartridge case 12 with extraction jaws 14 expanded and engaging the inner rim 13 of the cartridge 12. The extraction jaws 14 are disposed between a back up disc 15 and a retaining disc 16 and are held in place by bolts 17. Bolts 17 limit the radial expansion of the jaws 14 by virtue of the slots 24 (FIG. 3) and align the back up disc 15 with the retaining disc 16. The retaining disc 16 is mounted on a turbular housing 18, wherein a rod 19 is co-axially disposed. A cone 20, which causes the extraction jaws 14 to contract and to expand, is secured to the end of the rod 19.

On the other end of the rod 19 is a jam nut 21. On the other end of the tubular housing 18 is mounted a strong back 22, of sufficient length to span the breech face of the barrel 11, and an extractor nut 23 is threaded thereon.

OPERATION

Figure 2:
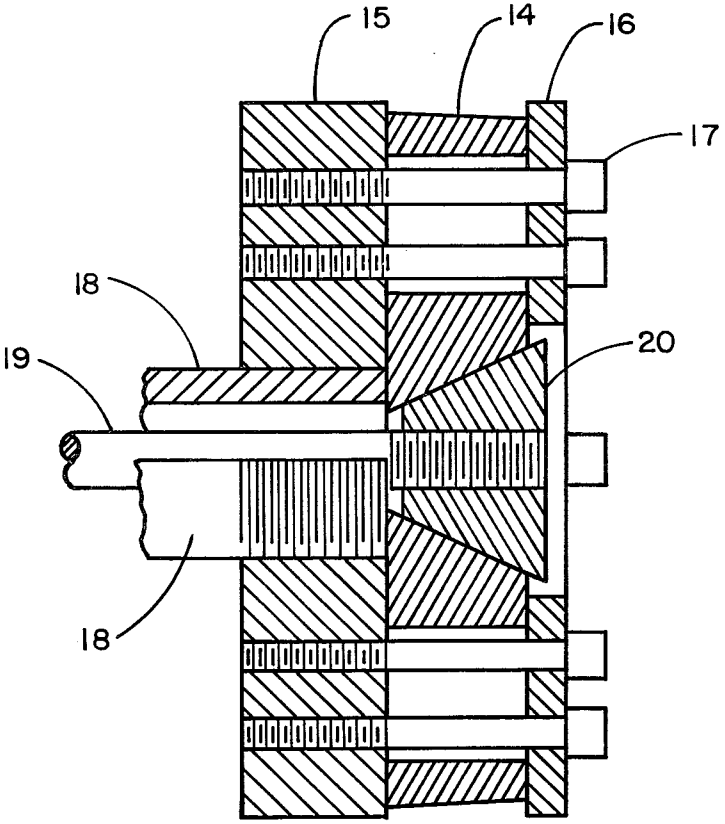
FIG. 2 is a partial view of device of FIG. 1 with the extraction jaws closed as in the insertion position.

In order that a better understanding of the invention might be had, its mode of operation will now be described. The tool 10 is inserted into the breech end of the gun 11 by screwing the jam nut 21 counter-clockwise, causing the cone to move to the right as viewed in FIG. 2, and hence the extraction jaws 14 are closed. After the extraction jaws 14 pass through the remaining portion of the cartridge case 13, the jam nut 21 is turned clockwise till tight, the cone 20 camming the extraction jaws 14 outwardly until they are lodged firmly against the inside of the barrel 11, as in FIG. 1. At this time, the strong back 22 is flush against the breech face of the barrel 11. To remove the cartridge case, the extraction nut 23 is turned clockwise, causing the extraction jaws 14 to dislodge the cartridge case 13.

From the foregoing it will be readily apparent that Applicant has provided a case extracting tool embodying numerous advantageous features not found in prior art devices. The circle defined by the arcuate peripheries of the jaws 14 when expanded has the same diameter as the outside diameter of the cartridge case 13. This insures that substantially the entire inner rim of the cartridge case is engaged by the extraction jaws rather than the two limited areas of contact provided by the prior art devices with their reduced diameters which were limited to, at best, the inner diameter of the cartridge case.

It is to be understood that the invention may be practiced other than as specifically described. Obviously, many modifications and variations of the present invention will readily occur to those skilled in the art in the light of the above teachings. It is therefore to be understood that within the scope of the appended claims the invention may be practiced otherwise than as specifically described.

What is claimed is:

1. A tool for extraction of ruptured cartridge cases from large caliber guns comprising:

an elongated tubular housing;

a plurality of jaws slidably mounted on one end of said housing for radial movement with respect to said housing, the periphery of each jaw being arcuate in configuration and having a radius of curvature equal to the radius of curvature of the gun barrel; and means on said housing for camming said jaws outwardly into engagement with the gun barrel whereby said jaws will engage the inner rim of the cartridge case and dislodge the cartridge case upon extraction of the tool.

2. A tool as defined in claim 1 wherein means are provided on the other end of said housing for applying an extracting force to said housing.

3. A tool as defined in claim 2 wherein said extracting force applying means comprises a strongback mounted on the end of said housing to straddle the breech opening, and an extraction nut threaded on said housing and engaging said strongback.

4. A tool as defined in claim 1 wherein said camming means comprises a rod co-axially disposed in said housing having a cam at one end engaging said jaws, whereby movement of said rod effects movement of said jaws radially with respect to said housing.

5. A tool as defined in claim 4 wherein a jam nut and washer are threaded on the other end of said rod for engaging the outside end of said tubular housing and effecting movement of said rod.

6. A tool as defined in claim 3 wherein said camming means comprises a rod co-axially disposed in said housing having a cam at one end engaging said jaws, whereby movement of said rod effects movement of said jaws radially with respect to said housing.

7. A tool as defined in claim 6 wherein a jam nut and washer are threaded on the other end of said rod for engaging the outside end of said tubular housing and effecting movement of said rod.

* * * * *